United States Patent [19]

Stenerson et al.

[11] Patent Number: 5,025,565

[45] Date of Patent: Jun. 25, 1991

[54] RANGE FINDING BOW SIGHT

[76] Inventors: C. Lee Stenerson, R.R. #1, Box 49, DeSota, Wis. 54624; Michael L. Stenerson, both of R.R. #1, Box 257, Ontario, Wis. 54651

[21] Appl. No.: 433,126

[22] Filed: Nov. 8, 1989

[51] Int. Cl.[5] ..... F41G 1/00

[52] U.S. Cl. ..... 33/265; 33/245; 124/87

[58] Field of Search ..... 33/265, 245, 233; 124/86, 87, 88, 89, 24 R, DIG. 1

[56] References Cited

U.S. PATENT DOCUMENTS

| | | | |
|---|---|---|---|
| 2,909,167 | 10/1959 | Frederickson | 124/24 R |
| 3,136,063 | 6/1964 | Stebbins | 124/24 R |
| 3,365,800 | 1/1968 | Carella | 33/265 |
| 3,561,418 | 2/1971 | Frederickson | 124/24 R |
| 4,329,972 | 5/1982 | Wilson | 124/24 R |
| 4,651,432 | 3/1987 | Bornancini | 33/233 |

FOREIGN PATENT DOCUMENTS

| | | | |
|---|---|---|---|
| 1073202 | 3/1980 | Canada | 33/233 |
| 188684 | 7/1986 | European Pat. Off. | 33/233 |
| 3102942 | 9/1982 | Fed. Rep. of Germany | 33/233 |

*Primary Examiner*—William A. Cuchlinski, Jr.
*Assistant Examiner*—D. Price
*Attorney, Agent, or Firm*—James C. Nemmers

[57] ABSTRACT

A sighht for a bow that will accurately sight the target at any distance within the range of the bow without knowing the distance to the target. The sight has two sets of cross hairs, one in the front and one in the rear, which create positive vertical and horizontal alignment. The distance between the front and rear cross hairs is adjustable so that it can be set for the pull of the particular bow with which the sight is used.

9 Claims, 3 Drawing Sheets

RANGE FINDING BOW SIGHT

BACKGROUND OF THE INVENTION

Whether hunting game or merely target shooting with a bow and arrow the problem of accurately sighting the target still exists. This is due principally because the trajectory of an arrow is substantially flat for only a relatively short distance. This distance when the arrow trajectory is about flat (commonly called the "dead on distance") is approximately 20 to 35 yards for most bows. The "dead on distance" is dependent upon the particular bow and especially its pull or poundage If the archer knows the distance to the target, there are quick adjusting sights that are reasonably accurate An example of such a bow sight is shown in Frydenlund U.S. Pat. No. 3,487,548. However, especially when hunting live game, the distance to the target is not known and must be estimated, and if the estimate is not reasonably accurate, the sight will not provide for an accurate hit. To aid the archer in these situations, there are available range finders which will provide a reasonably accurate measurement of the distance. In some instances, the range finder is combined with the sight, but this still requires the archer to first determine the range, and once determined, use the sight before releasing the arrow. This obviously involves two steps, and when hunting live game, the archer may not have the time to go through these two steps. An example of a combination range finder and bow sight is shown in Larson U.S. Pat. No. 3,696,517.

In an effort to overcome the disadvantages of the foregoing types of bow sights, there have been attempts to develop combination range finders and bow sights that will more readily and accurately assist the archer in providing an accurate sight of the target. Sprandel U.S. Pat. No. 3,666,368, Davidson U.S. Pat. No. 3,875,674 and Stuchnick U.S. Pat. No. 4,418,479 are examples of attempts at providing a sight that will be accurate over a considerable range from the archer to the target. However, these prior art devices are relatively complex and expensive and not easy to use. There is therefore a need for a simple, inexpensive and easy to use bow sight which will automatically compensate for differences in the distance between the archer and the target.

SUMMARY OF THE INVENTION

The invention consists of a simple tubular member that is mountable on the bow and which contains a set of cross hairs. The tubular member has a telescoping portion which contains a second set of cross hairs which are thus positionable at different distances from the first set of cross hairs. The mounting for the sight permits adjustability by providing for vertical tilt within a limited range. By presetting the adjustments so that the arrow will be dead on target for a distance of up to 35 yards (depending upon the poundage of the bow) the sight will provide the archer with an accurate sight of the target and produce a accurate hit at any distance up to the limits of the dead on distance. Beyond the limits of the dead on distance, the sight will automatically compensate for the distance and provide an accurate trajectory for the arrow.

BRIEF DESCRIPTION OF THE DRAWINGS

FIG. 10 is a view similar to FIG. 9 but illustrating the archer's view of a target at a distance beyond dead on.

DESCRIPTION OF THE PREFERRED EMBODIMENT OF THE INVENTION

Figure 4:
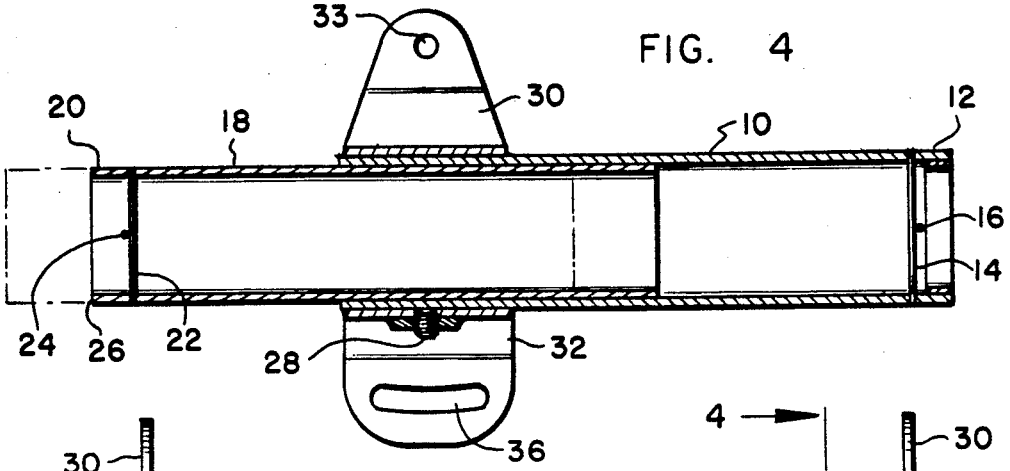
FIG. 4 is a sectional view of the sight taken on the line 4—4 of FIG. 2.
Figure 3:
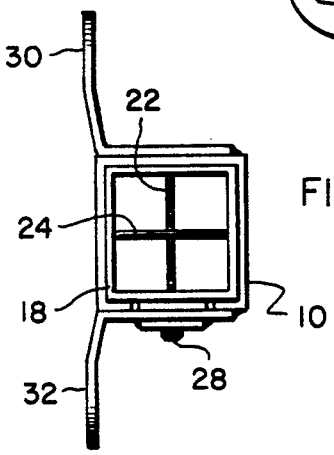
FIG. 3 is a front elevational view of the sight.
Figure 2:
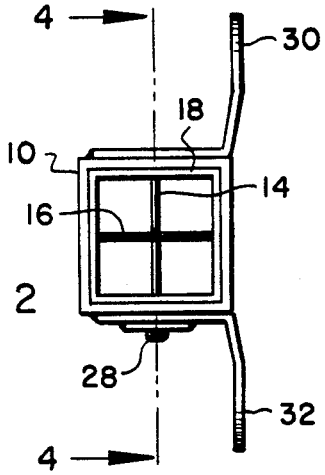
FIG. 2 is a rear elevational view of the sight.
Figure 1:
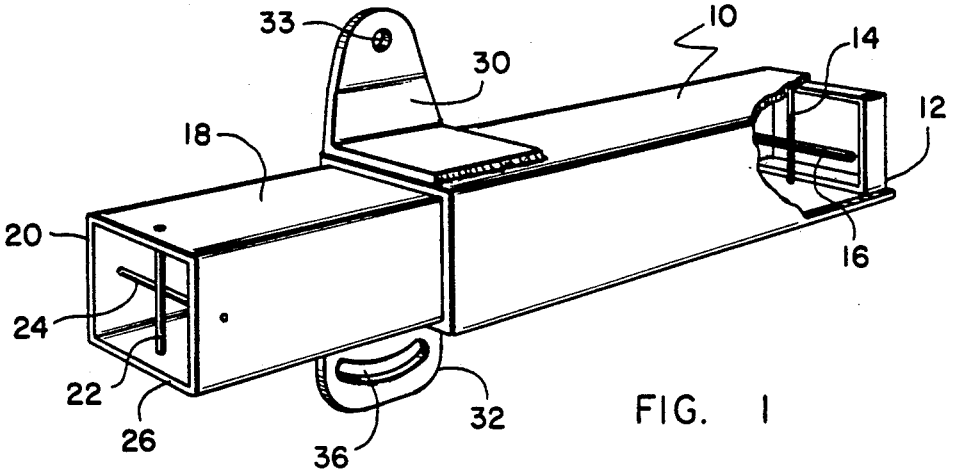
FIG. 1 is a perspective view of the sight of the invention.

The device of the invention is a simple device that will, however, accurately sight a bow and arrow at a target at any distance within the range of the particular bow and arrow even though the distance to the target is unknown to the archer. Therefore, the device is not only a sight but also automatically operates as a range finder To accomplish this, the device of the invention consists of an outer longitudinally extending tube 10 that is preferably square in shape and which has at its outer end 12 a vertical cross hair !4 and a horizontal cross hair 16 each centered in the opening or window defined by the outer end 12. The sight of the invention also has an inner tube 18 of the same cross sectional shape as tube 10, but the outside dimensions of inner tube 18 are slighty smaller than the inside dimensions of the outer tube 10 so that tube 18 can be telescoped inside of the outer tube 10 and moved longitudinally with respect to the outer tube 10. Inner tube 18 also is therefore preferably square in cross section and has at its outer end 20 a vertical cross hair 22 and a horizontal cross hair 24, each of which are centered in the opening defined by the outer end 20. As best seen in FIG. 1, the outer end 12 of the tube 10 and the outer end 20 of the tube 18 are at opposite ends of the sight of the invention, and the distance between the pairs of cross hairs can be varied by sliding the inner tube 18 relative to the outer tube 10. To maintain a selected relative position of the inner tube 18 and outer tube 10 there is provided a set screw 28 or other suitable means to lock the two tubes 10 and 18 together. This is best seen in FIG. 4. The outer end 20 of inner tube 18 also has a lower edge 26 which partially defines the opening or window in which cross hairs 22 and 24 are positioned with the lower edge 26 parallel to the horizontal cross hair 24.

In order to mount the sight of the invention on a bow, the sight has affixed to the outer tube 10 an upper bracket 30 and a lower bracket 32. The upper bracket 30 contains an opening 33 through which a fastener, such as screw 34 (see FIGS. 6, 8, 9 and 10), can be inserted Similarly, the lower bracket 32 has an arcuate slot 36 through which there is inserted a suitable fastener having a wing nut 38. Thus, when the sight is mounted on a bow 40 in the position illustrated in FIG. 6, the outer end 20 of the inner tube 18 can be tilted upwardly or downwardly to a selected positon and locked in place using the wing nut 38.

Figure 8:
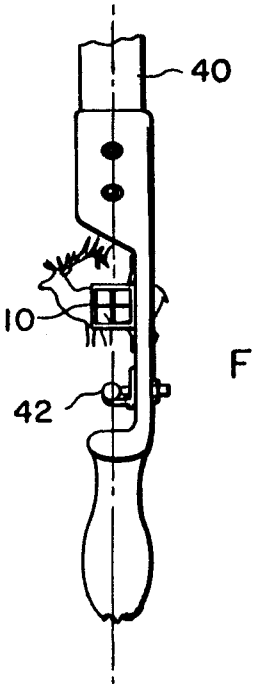
FIG. 8 is a view illustrating what the archer sees when a target is dead one.
Figure 5:
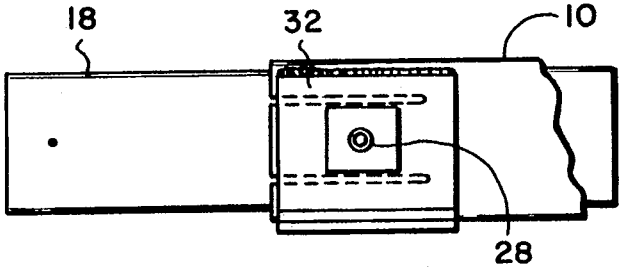
FIG. 5 is a bottom view of the sight illustrating the adjusting set screw.
Figure 6:
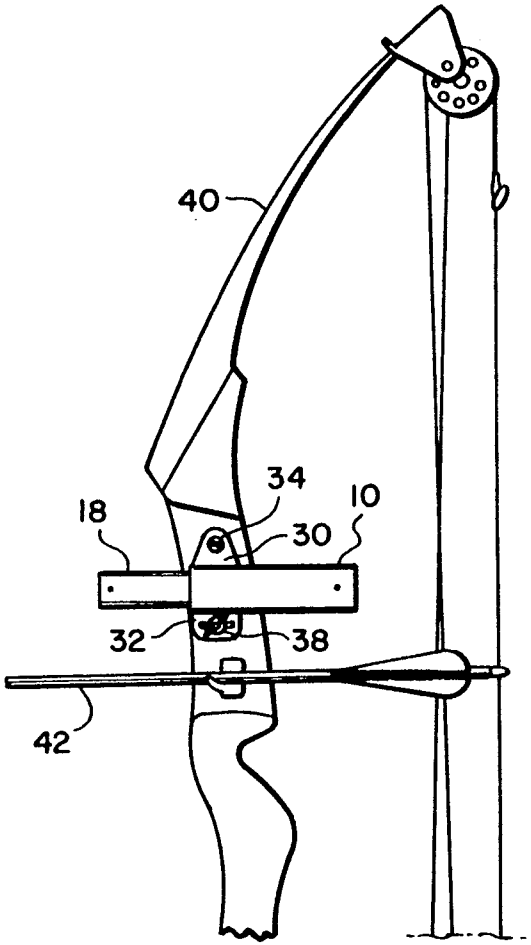
FIG. 6 is a side elevational view showing the sight mounted on a typical bow.
Figure 7:
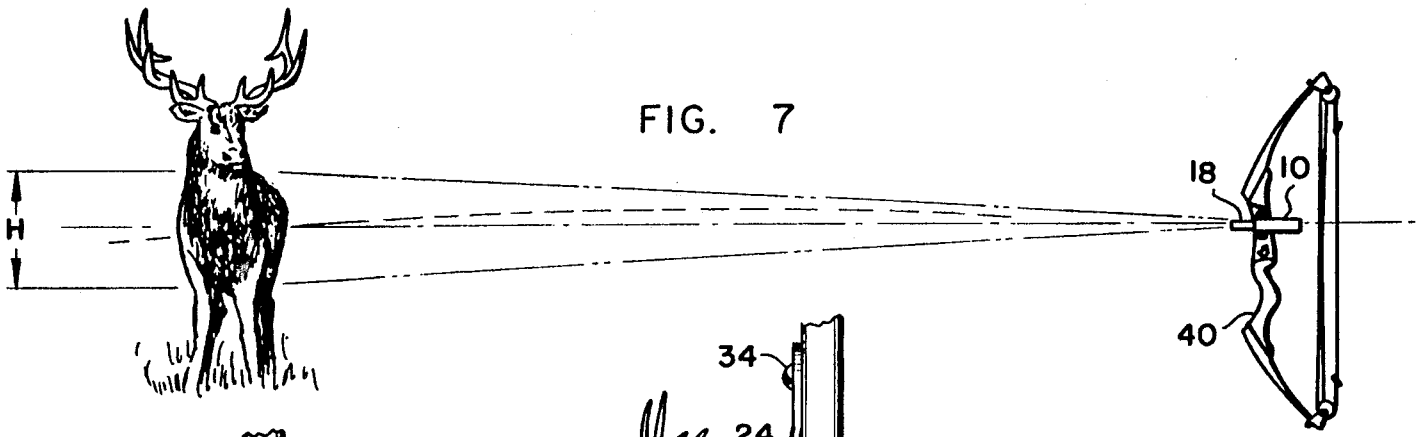
FIG. 7 is a view of a target and bow illustrating the arrow trajectory within the dead on distance.
Figure 9:
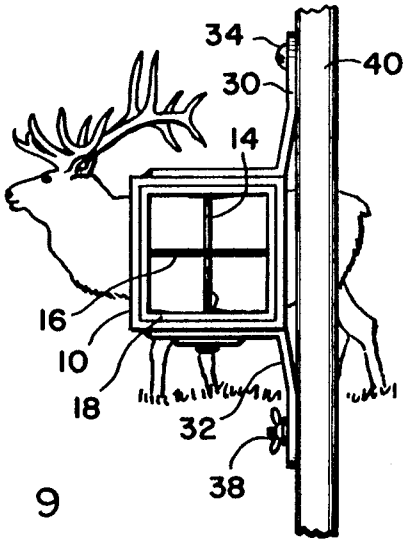
FIG. 9 is an enlarged view of a portion of FIG. 8 further illustrating the view of the target by the hunter.

The features and function of the sight of the invention can best be illustrated by an explanation of its use. After the sight of the invention is mounted on the bow 40 above the arrow 42 as illustrated in FIG. 6, the tilt of the sight is adjusted so that the arrow will be dead on target at a distance of 25 to 35 yards. The exact dead on distance depends upon the pull or poundage of the bow, and the higher the poundage, the farther the arrow 42 will follow the substantially flat trajectory of the dead on distance. With the archer standing at the dead on distance from the target, the set screw 28 is loosened and the inner tube 18 is moved inwardly or outwardly until the target fills the full sight window as illustrated in FIGS. 7, 8 and 9. If the target is a deer, for example, 18 inches (back line to belly line) in actual height of the target should fill the sight window if the inside dimensions of the tubes 10 and 18 are properly sized In the sight of the invention, we have determined that for every four and ½ inches of target height, the height of the sight window (defined by the outer end 20 of inner tube 18) must be one-eighth inch in order for the target to fill the sight window at the dead on distance. The following table therefore illustrates the tube-to-target ratio that should be used when selecting a sight of proper dimensions for a particular target:

| Height of Tube Window | Height of Target |
|---|---|
| ⅛ Inch | 4½ Inches |
| ¼ Inch | 9 Inches |
| ⅜ Inch | 13½ Inches |
| ½ Inch | 18 Inches |
| ⅝ Inch | 22½ Inches |
| ¾ Inch | 27 Inches |
| ⅞ Inch | 31½ Inches |
| 1 Inch | 36 Inches |

For example, if deer having a back-to-belly line of 18 inches are being hunted, a sight having a window height of ½ inch should be used, whereas if elk (back-to-belly line of 31½ inches) are being hunted, a sight should be selected in which the window height is ⅞ of an inch.

From the foregoing, it will be seen that if the properly sized sight is selected for the target being hunted, and if the sight is initially adjusted as described above, an accurate hit will be made at any time the target fills the sight window with the horizontal cross hair 24 aligned with the horizontal cross hair 16. In such an instance, the target will be within the dead on distance in which the trajectory of the arrow 42 is substantially flat, and the arrow 42 should hit the target in the center of the aligned vertical cross hairs 22 and 14. FIG. 7 illustrates the proper adjustment for the dead on distance, with the target being positioned at the dead on distance. In FIG. 7, the height of the target (indicated by the letter H) will completely fill the sight window as illustrated in FIG. 9, the arrow following a trajectory of the dotted line shown in FIG. 7 which is substantially a flat trajectory.

Figure 10:
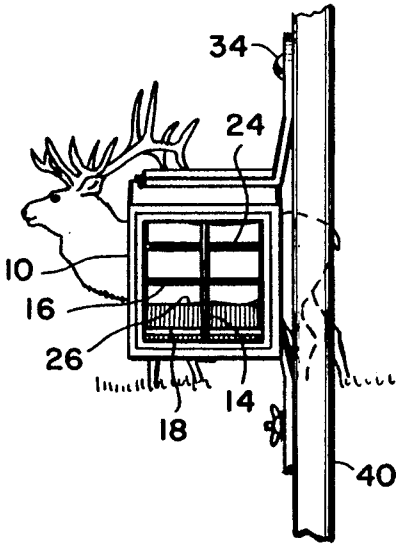
Figure 11:
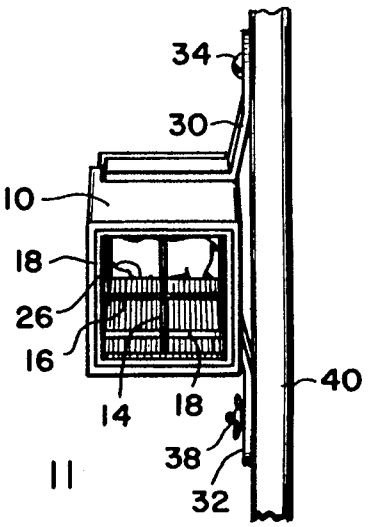
FIG. 11 is a view similar to FIG. 10 and illustrating the archer's view of a target at a still farther distance than that illustrated in FIG. 10.

When the target animal is farther away than the dead on distance, the archer will have to lower the anchor point (the string hand) until the target animal fills the sight window once again as illustrated in FIGS. 10 and 11. When the anchor point is lowered, this tilts the sight upwardly creating a smaller sight window since the horizontal cross hairs 24 and 16 will no longer be in alignment and the lower edge 26 of the outer end 20 will come into view and effectively shrink the heighth of the sight window. This is illustrated in FIG. 10 for a target animal that is beyond the dead on distance, while FIG. 11 illustrates the view through the sight window for a target animal that is still farther away from the archer. By thus tilting the sight, the bow 40 will also be tilted upwardly, and the trajectory of the arrow 42 will start out upwardly to a peak and then curve downwardly until it hits the target at a point where the trajectory intersects the straight line of sight. At this point, the arrow should hit the target in the center of the vertical cross hairs 22 and 14. When used in this manner, the sight of the invention will give the bow an accurate trajectory of the arrow 42 for approximately 2½ times the dead on distance. For example, if the dead on distance for a particular bow is 30 yards, the sight of the invention will permit the archer to make accurate hits at a distance of up to 75 yards.

The use of the sight of the invention has been described in all instances with the vertical cross hairs 22 and 14 being in alignment. In the event of a cross wind, the archer can move the anchor point (string hand) to the right or to the left to compensate for any cross wind. Also, once the sight of the invention is properly adjusted for a particular bow, no more adjustments are need on the sight for that particular bow. If a target animal of a different size is being hunted, the user should select the size of the sight according to the table set forth above. Occasionally, even though the sight of the invention is properly mounted and adjusted initially, if the target animal is beyond the dead on distance and the arrow is hitting above the target, the set screw 28 can be loosened and the inner tube 18 moved outwardly relative to the outer tube 10 so as to increase the distance between the cross hairs. Similarly, if the user finds that the arrow is hitting below the target when the target is beyond the dead on distance, the distance between the two sets of cross hairs can be shortened to compensate. However, once the sight is properly adjusted for a particular bow, no further adjustments should be needed.

From the foregoing description, it will be evident that the sight of the invention provides a sight that is extremely simple to use, and one that is once adjusted needs no further adjustment when the archer is in the field hunting. All the archer has to do is make certain that the target animal fills the sight window in the manner described herein and accurate hits will result. This is accomplished without the archer being required to measure or know the distance to the target, since the sight serves automatically as a range finder without any further movement or adjustment to the sight other than the initial set up and adjustment. Also, if properly used, the sight of the invention will inform the archer when the target is beyond dead on range, and allow the archer to adjust the anchor point immediately to assure an accurate hit. Thus, the sight of the invention provides simple and substantially full proof use that will improve the number of hits obtained by the user. We have described the invention in connection with the preferred embodiment thereof, but it will be evident to those skilled in the art that various revisions and modifications can be made to the preferred embodiment described herein without departing from the spirit and scope of the invention. It is our intention, however, that all such revisions and modifications that may be obvious to those skilled in the art will be included within the scope of the following claims.

What is claimed is as follows:

1. A sight for use with an archery bow to assist the user in properly aiming the bow at a target, said sight comprising: a first tubular sight member defining a first sight window through which the target is viewed, a first horizontal cross hair and a first vertical cross hair fixed relative to the first sight window, a second tubular sight member defining a second sight window through which the target is viewed, a second horizontal cross hair and a second vertical cross hair fixed relative to the second sight window, the first and second sight members being telescoped one into the other and slidable relative to each other, means for maintaining the sight members in a selected relative position, means for mounting the first and second sight members on the bow so that the first and second sight windows are in general alignment between the user's line of sight and the target, the first and second vertical cross hairs being aligned by the user when the bow is properly aimed at the target, and means for varying the distance between the first and second sight windows.

2. The sight of claim 1 in which the first and second sight windows each have edges that form a rectangular window, and the cross hairs are parallel to the edges of the window.

3. The sight of claim 2 in which the mounting means provides for tilting of the sight in a vertical plane relative to the bow.

4. A sight for use with an archery bow to assist the user in properly aiming the bow at a target, said sight comprising: a first sight member having an outer edge that circumscribes a first sight window through which the target is viewed, a first horizontal reference line fixed relative to the first sight window, a second sight member having an outer edge that circumscribes a second sight window through which the target is viewed, a second horizontal reference line fixed relative to the second sight window, the first and second sight windows being the same geometric shape and substantially the same size, means for mounting the first and second sight members on the bow so that the alignment of the first and second sight windows from the user's line of sight to the target is fixed, and means providing for varying the distance between the first and second sight windows along said alignment.

5. The sight of claim 4 in which the first and second horizontal reference lines are cross hairs, and each of the cross hairs is combined with a vertical cross hair, which vertical cross hairs are aligned by the user when the bow is properly aimed at the target.

6. The sight of claim 4 in which the first and second sight members are each tubular members, one such member being telescoped into the other and slidable relative thereto, and means is provided to maintain the members in a selected relative position.

7. The sight of claim 6 in which the outer edges that circumscribe the first and second sight windows from rectangular windows, and the cross hairs are parallel to the edges of the window.

8. The sight of claim 7 in which the mounting means provides for tilting of the sight in a vertical plane relative to the bow.

9. The sight of claim 6 in which the height of each of the first and second sight windows relative to the height of the target is in a ratio of one-to-thirty-six.

* * * * *